US010525573B2

(12) United States Patent
Yamaguchi et al.

(10) Patent No.: US 10,525,573 B2
(45) Date of Patent: Jan. 7, 2020

(54) TIGHTENING OPERATION ANALYSIS APPARATUS, TIGHTENING OPERATION ANALYSIS SYSTEM, TIGHTENING OPERATION ANALYSIS PROGRAM, TIGHTENING OPERATION ANALYSIS METHOD, AND TIGHTENING TOOL

(71) Applicant: KYOTO TOOL CO., LTD., Kyoto (JP)

(72) Inventors: Yoshiyuki Yamaguchi, Kyoto (JP); Yuki Okawa, Kyoto (JP); Yoshiharu Matsumoto, Kyoto (JP)

(73) Assignee: KYOTO TOOL CO., LTD., Kyoto (JP)

( * ) Notice: Subject to any disclaimer, the term of this patent is extended or adjusted under 35 U.S.C. 154(b) by 0 days.

(21) Appl. No.: 16/114,285

(22) Filed: Aug. 28, 2018

(65) Prior Publication Data

US 2019/0061122 A1 Feb. 28, 2019

(30) Foreign Application Priority Data

Aug. 29, 2017 (JP) ..... 2017-164256

(51) Int. Cl.
*B25B 23/00* (2006.01)
*B25B 23/142* (2006.01)

(52) U.S. Cl.
CPC ..... *B25B 23/1425* (2013.01); *B25B 23/1427* (2013.01)

(58) Field of Classification Search
CPC ..... B25B 23/1425; B25B 23/1427
(Continued)

(56) References Cited

U.S. PATENT DOCUMENTS 6,439,064 B1 * 8/2002 Fanguy ..... B25B 13/5016 73/862.25
2002/0139201 A1 * 10/2002 Fanguy ..... B25B 13/5016 73/862.21

(Continued)

FOREIGN PATENT DOCUMENTS

CN 20 5968804 U 2/2017
DE 2020-10001831 U1 8/2010

(Continued)

OTHER PUBLICATIONS

Office Action dated Apr. 25, 2019 issued on the corresponding Taiwanese application No. 107130030.

*Primary Examiner* — Max H Noori
(74) *Attorney, Agent, or Firm* — Bacon & Thomas, PLLC

(57) ABSTRACT

There is provided a tightening operation analysis apparatus configured to analyze a tightening operation performed by a worker using a tightening tool. The tightening tool includes a head configured to be able to engage with a tightened member, and a main body configured to pivotally engage with the head and turn when a tightening torque for tightening the tightened member reaches a preset torque value. The tightening operation analysis apparatus includes a motion information acquisition unit configured to acquire motion information indicating a turning motion of the main body, from the tightening tool, and an analysis unit configured to output a result of analysis of a load condition of the tightened member during the tightening operation, based on the motion information acquired by the motion information acquisition unit.

4 Claims, 15 Drawing Sheets

(58) Field of Classification Search
USPC ..... 73/862.21
See application file for complete search history.

(56) References Cited

U.S. PATENT DOCUMENTS

| | | | | |
|---|---|---|---|---|
| 2002/0152849 | A1* | 10/2002 | Jenkins | B25B 23/1425 81/479 |
| 2008/0127711 | A1* | 6/2008 | Farag | B25B 23/1425 73/1.11 |
| 2010/0058901 | A1* | 3/2010 | Calloway | B25B 23/14 81/479 |
| 2010/0265097 | A1 | 10/2010 | Obatake et al. | |
| 2012/0079923 | A1 | 4/2012 | Huang | |
| 2016/0129569 | A1 | 5/2016 | Lehnert et al. | |

FOREIGN PATENT DOCUMENTS

| | | | |
|---|---|---|---|
| JP | 2007-283455 | A | 11/2007 |
| JP | 2008-307670 | A | 12/2008 |
| JP | 2014-037041 | A | 2/2014 |
| TW | M381484 | U | 6/2010 |
| TW | M-405939 | U | 6/2011 |
| TW | 2011-31955 | A | 9/2011 |
| TW | 2015-05781 | A | 2/2015 |

* cited by examiner

TIGHTENING OPERATION ANALYSIS APPARATUS, TIGHTENING OPERATION ANALYSIS SYSTEM, TIGHTENING OPERATION ANALYSIS PROGRAM, TIGHTENING OPERATION ANALYSIS METHOD, AND TIGHTENING TOOL

CROSS-REFERENCE TO RELATED APPLICATIONS

The present application claims priority from Japanese Patent Application No. 2017-164256 filed on Aug. 29, 2017, the entire contents of which are hereby incorporated by reference.

BACKGROUND

1. Technical Field

The present invention relates to a tightening operation analysis apparatus, a tightening operation analysis system, a tightening operation analysis program, a tightening operation analysis method, and a tightening tool.

2. Related Art

A torque wrench has been known as a tightening tool to control a tightening torque. The torque wrench is configured to notify a worker that a tightening torque generated by tightening a tightened member such as a bolt and a nut at a tightening point reaches a torque value previously set for the tightening tool (hereinafter "preset torque value").

In the case of a mechanical torque wrench, when the tightening torque reaches a preset torque value, which is applied by the worker who is holding a casing as a main body of the torque wrench to tighten the tightened member, the casing is turned around a head pin pivotally supporting a head and the casing in a first direction which is the same as the tightening direction to tighten the tightened member. In this case, the head contacts a portion such as the casing and therefore produces a clicking noise and a vibration which can be perceived by the worker. By this means, the worker knows that the tightening torque reaches the preset torque value. After that, when the worker stops applying the force to the torque wrench, the casing turns in a second direction opposite to the first direction (tightening direction), and returns to the initial position. Some mechanical torque wrenches may change the preset torque value by rotating a dial rotating member to adjust the compressive force of a spring.

Here, in order to detect a turning motion of the casing with respect to the head of the mechanical torque wrench, a technologies for detecting a turning motion of the head has been disclosed, for example, in Japanese Patent Application Laid-Open Nos. 2007-283455, 2008-307670 and 2014-037041. JP2007-283455 discloses a technology as a method including: detecting sound generated by the torque bar to output an electric signal corresponding to the sound; analyzing the electric signal and analyzing the presence/absence of sound of the specific pattern to determine whether or not one thread fastening is completed; and integrating the number of threads completing fastening every time fastening of one thread is determined to be completed and outputting the integrated value. JP2008-307670 discloses a technology including use of a hall element to detect an actuation of a toggle mechanism and determine that tightening operation is completed. JP2014-037041 discloses a technology including measuring the rotation angle of an angle wrench in a tightening operation after the torque-detecting mechanism has detected that the specified torque has been reached, on the basis of the angular velocity of the angle wrench around the axis of the object being tightened.

However, with the technologies disclosed in the above-described patent literatures, it is not possible to analyze the load condition of the tightened member, although the mechanical torque wrench can measure the number of tightened members and the rotation angle of the tool during the tightening operation. To be more specific, with the technologies disclosed in the above-described patent literatures, it is not possible to analyze whether the tightening torque has an excessive torque value which exceeds the preset torque value, that is, so called "overtorque."

SUMMARY OF THE INVENTION

It is desirable to provide a tightening operation analysis apparatus, a tightening operation analysis system, a tightening operation analysis program, a tightening operation analysis method, and a tightening tool capable of analyzing the load condition of a tightened member during the tightening operation by using a tightening tool configured to turn the main body when the tightening torque reaches a preset torque value.

An aspect of the present invention provides a tightening operation analysis apparatus configured to analyze a tightening operation performed by a worker using a tightening tool. The tightening tool includes a head configured to be able to engage with a tightened member, and a main body configured to pivotally engage with the head and turn when a tightening torque for tightening the tightened member reaches a preset torque value. The tightening operation analysis apparatus includes a motion information acquisition unit configured to acquire motion information indicating a turning motion of the main body, from the tightening tool, and an analysis unit configured to output a result of analysis of a load condition of the tightened member during the tightening operation, based on the motion information acquired by the motion information acquisition unit.

The analysis unit may analyze whether the tightening torque has an excessive torque value greater than the preset torque value, based on the motion information.

The tightening tool may include a light emitting element and a light receiving element configured to acquire a turning motion of the main body, and the motion information acquisition unit may acquire an electric signal outputted based on a variation in a light receiving state of the light receiving element as the motion information.

The analysis unit may output the result of analysis of the tightening operation, based on a voltage of the electric signal and a period of time for which the electric signal is outputted.

The tightening tool may include a heat pin pivotally supports the head and the main body, the main body may turn around the head pin in a first direction, and then turns in a second direction when the tightening torque reaches the preset torque value, and the motion information acquisition unit may acquire information indicating that the head has turned in the first direction and the second direction as the motion information.

The analysis unit may identify a load condition of the tightened member during the tightening operation, based on a period of time for which the main body turns in the first direction and then turns in the second direction, the period of time being contained in the motion information.

An aspect of the present invention provides a tightening operation analysis system including: a tightening tool used in a tightening operation performed by a worker; and a tightening operation analysis apparatus configured to analyze the tightening operation by using the tightening tool. The tightening tool includes: a head coupled to a tightened member; a main body configured to pivotally engage with the head and turn when a tightening torque generated during the tightening operation reaches a preset torque value; and a turn detector configured to detect motion information indicating a turning motion of the main body. The tightening operation analysis apparatus includes: a motion information acquisition unit configured to acquire the motion information from the tightening tool; and an analysis unit configured to output a result of analysis of a load condition of the tightened member during the tightening operation, based on the motion information acquired by the motion information acquisition unit.

An aspect of the present invention provides a non-transitory computer readable medium storing a tightening operation analysis program that causes a computer to execute a process including: acquiring motion information indicating a turning motion of a main body from a tightening tool, the tightening tool including the main body and a head coupled to a tightened member, the main body pivotally engaging with the head and turning when a tightening torque generated during a tightening operation performed by a worker to tighten the tightened member reaches a preset torque value; and outputting a result of analysis of a load condition of the tightened member during the tightening operation, based on the motion information.

An aspect of the present invention provides a tightening operation analysis method executed by a computer. The method includes: acquiring motion information indicating a turning motion of a main body from a tightening tool, the tightening tool including the main body and a head coupled to a tightened member, the main body pivotally engaging with the head and turning when a tightening torque for tightening the tightened member by a worker during a tightening operation reaches a preset torque value; and outputting a result of analysis of a load condition of the tightened member during the tightening operation, based on the motion information.

An aspect of the present invention provides a tightening tool including: a head configured to be able to engage with a tightened member; a main body configured to pivotally engage with the head and turn when a tightening torque for tightening the tightened member reaches a preset torque value; a turn detector configured to detect motion information indicating a turning motion of the main body; a motion information acquisition unit configured to acquire the motion information; and an analysis unit configured to output a result of analysis of a load condition of the tightened member during a tightening operation to tighten the tightened member, based on the motion information acquired by the motion information acquisition unit.

According to the present invention, it is possible to analyze the load condition of a tightened member during the tightening operation by using the tightening tool configured to turn the main body when the tightening torque reaches the preset torque value.

DETAILED DESCRIPTION

Hereinafter, embodiments of the tightening operation analysis apparatus, the tightening operation analysis system, the tightening operation analysis program, the tightening operation analysis method, and the tightening tool according to the present invention will be described with reference to the drawings.

<Configuration of Tightening Operation Analysis System>

Figure 1:
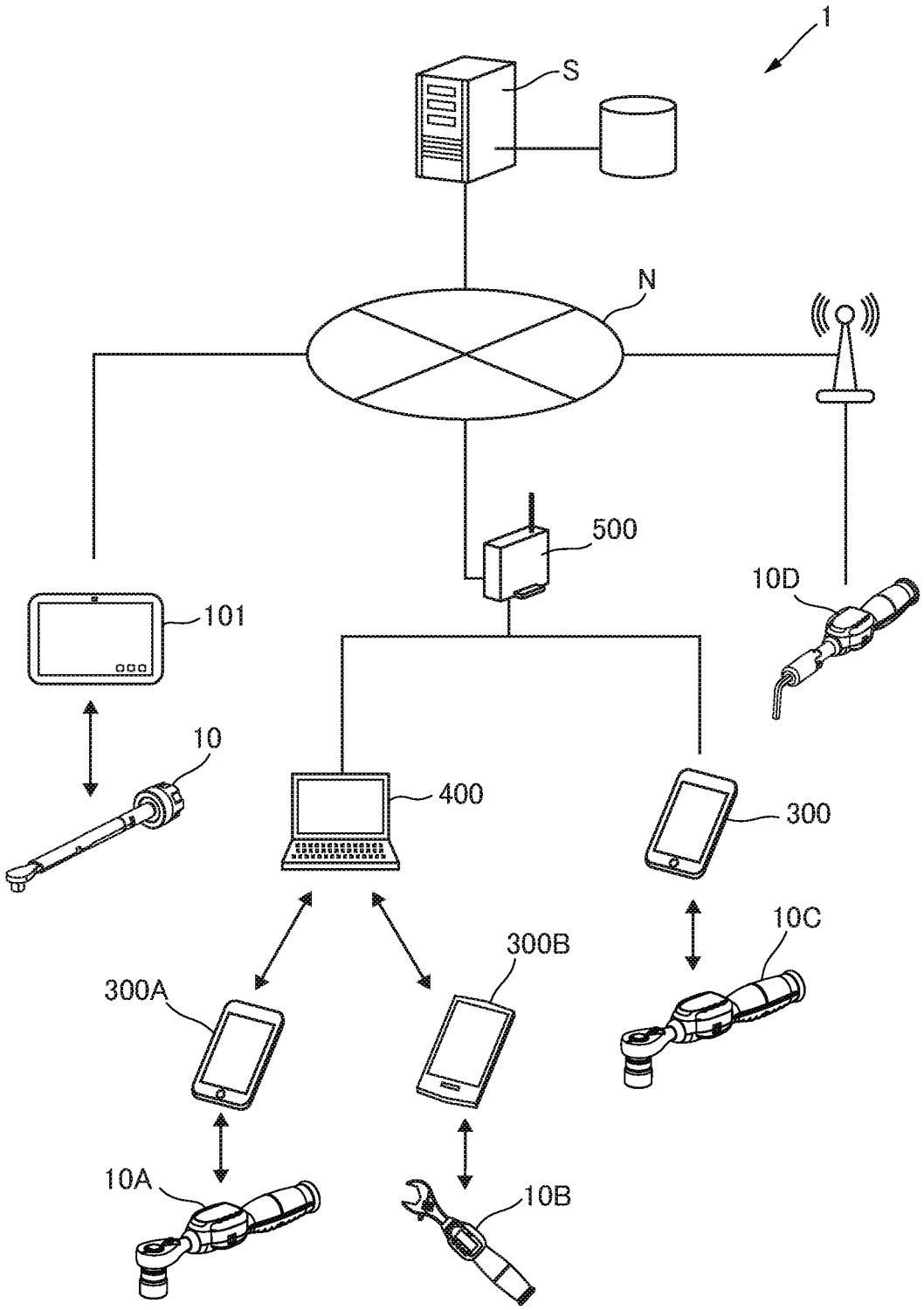
FIG. 1 is a schematic view illustrating a tightening operation analysis system according to an embodiment of the present invention.

FIG. 1 is a schematic view illustrating a tightening operation analysis system 1 according to an embodiment of the present invention. As illustrated in FIG. 1, the tightening operation analysis system I includes a torque wrench 10, and a tablet computer 101 of a tool station 100. The torque wrench 10 is an example of tightening tools used to tighten a tightened member by a worker. The computer 101 is an exemplary tightening operation analysis apparatus configured to analyze the tightening operation by using the torque wrench 10. In the tightening operation analysis system 1, the torque wrench 10 and the computer 101 are connected to one another by any type of computer network N such as WAN (Wide Area Network), for example, Internet, or LAN (Local Area Network) by wire, or wireless using a wireless LAN router. Also a server S is connected to the computer network N. The server S manages various pieces of information on the tightening operation acquired by the torque wrench 10 and the computer 101.

The torque wrench 10 includes a head coupled to a tightened member, a main body configured to turn when a tightening torque generated during the tightening operation reaches a preset torque value, and a turn detector configured to detect motion information indicating a turning motion of the main body. As the torque wrenches 10, 10A, 10B, and 10C, the tightening tools can be connected to the computer network N via information processing terminals such as the computers 101 and 400, and smartphones 300, 300A, and 300B. In addition, the tightening tool as a torque wrench 10D may be connected directly to the computer network N without the information processing terminal.

The computer 101 of the tool station 1 includes a motion information acquisition unit configured to acquire motion information from the torque wrench 10, and an analysis unit configured to output the result of analysis of the overload condition of the tightened member during the tightening operation, based on the motion information acquired by the motion information acquisition unit. The specific configurations and operations of the torque wrench 10 and the computer 101 will be described later.

<Configuration of Torque Wrench>

Figure 2:
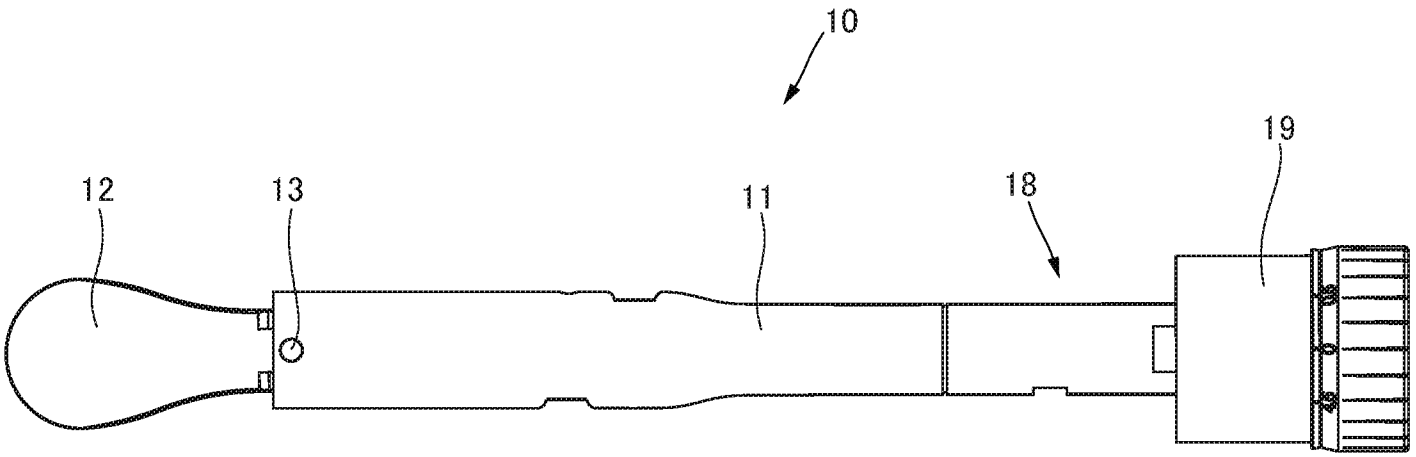
FIG. 2 is a front view illustrating a torque wrench as a tightening tool according to an embodiment of the present invention.

FIG. 2 is a front view illustrating the torque wrench 10 as a tightening tool according to an embodiment of the present invention.

With the present embodiment, a mechanical torque wrench will be described as an example of tightening tools configured to notify the worker that the tightening torque reaches a preset torque value by producing a clicking noise and a vibration perceived by the worker. In the case of the mechanical torque wrench, when the tightening torque reaches the preset torque value by tightening the tightened member, a casing is turned around a head pin pivotally supporting the casing and a head in a first direction which is the same as the tightening direction to tighten the tightened member. In this case, the casing is turned in the first direction and contacts a portion such as the head and therefore produces a clicking noise and a vibration which can be perceived by the worker. By this means, the worker is notified that the tightening torque reaches the preset torque value. Then, the worker stops applying the force to the torque wrench in response to the notice from the torque wrench. When the tightening torque is reduced to a value equal to or lower than the preset torque value, the casing of the mechanical torque wrench turns in a second direction (loosening direction) opposite to the first direction, and returns to the initial position.

In addition, as other examples of the mechanical torque wrench, there is a so-called prelock torque wrench which needs a tool for setting a torque value operated by the worker to change the preset torque value, and a so-called preset torque wrench which allows the preset torque value to be changed by the operation of the worker without any tool.

As illustrated in FIG. 2, the torque wrench 10 is a mechanical preset torque wrench as described above. The torque wrench 10 includes a casing 11, a head 12, a head pin 13, a torque value setting unit 18, a rotation angle detector 19 and so forth. When the head 12 contacts the casing 11 due to a torque generated by a tightening operation, the torque wrench 10 produces a clicking noise and a vibration which can be perceived by the worker to notify the worker that the tightening torque reaches the preset torque value.

The casing 11 having an approximately cylindrical shape is configured to accommodate components of the torque wrench 10 such as the head 12, and form the outer shape of the torque wrench 10. The casing 11 forming the outer shape of the torque wrench 10 may be referred to as "main body." The head 12 is provided at one end (first end) of the casing 11. In addition, the torque value setting unit 18 and the rotation angle detector 19 are provided at the other end (second end) of the casing 11. The second end of the casing 11 functions as a grip held by the worker when the worker performs a tightening operation by using the torque wrench 10. Here, a grip (not illustrated) made of resin may be integrally or detachably attached to the casing 11. Meanwhile, the casing 11 may be held directly by the worker to function as a grip.

Figure 3:
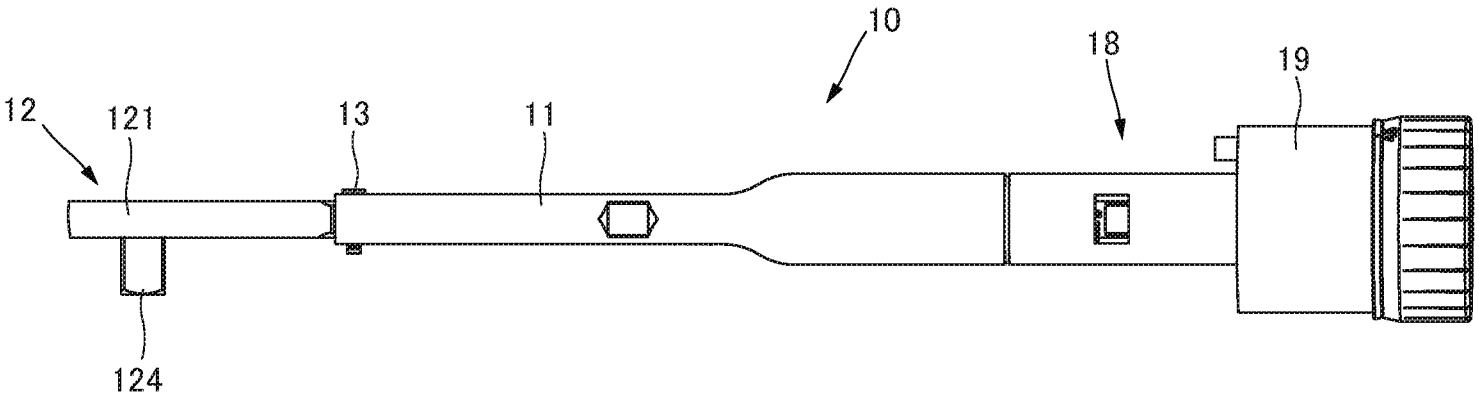
FIG. 3 is a bottom view illustrating the torque wrench illustrated in FIG. 2.

FIG. 3 is a bottom view illustrating the torque wrench 10. As illustrated in FIG. 3, the head 12 includes a ratchet head 121. When the tightened member is a bolt or nut, the ratchet head 121 is provided with a socket connector 124 to allow a socket wrench (not illustrated) engaging with the tightened member to be detachably attached to the ratchet head 121.

Figure 4:
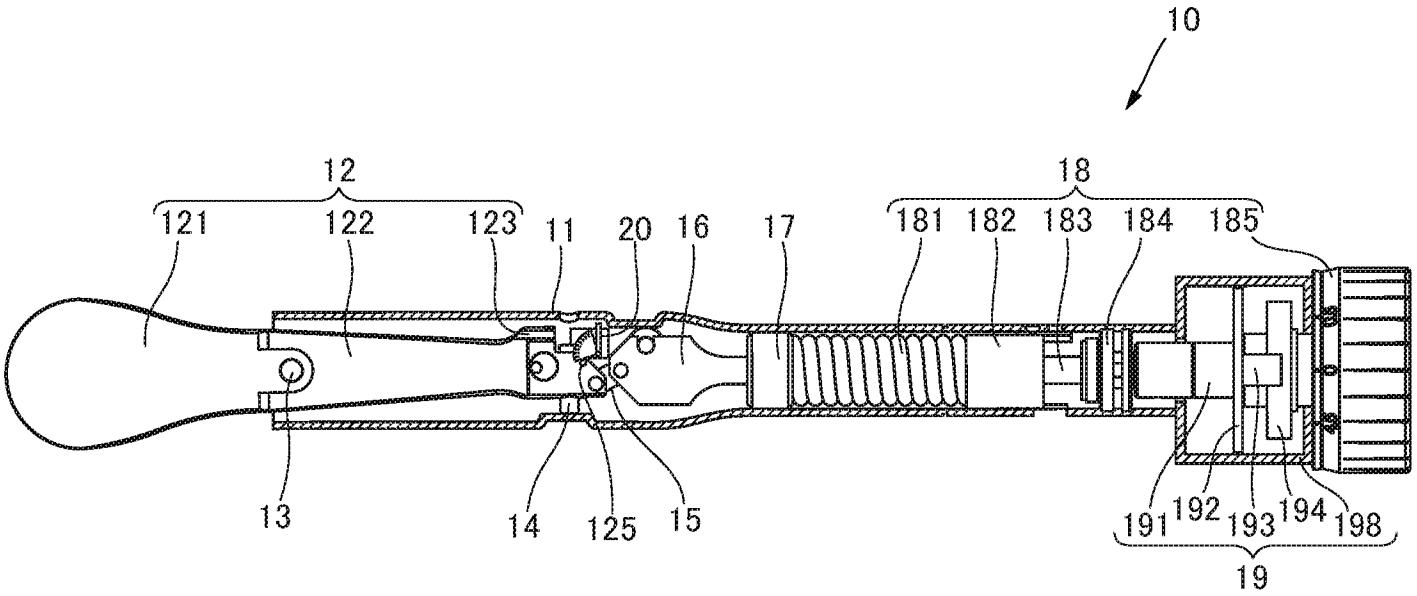
FIG. 4 is a partial cross-sectional view illustrating the internal structure of the torque wrench illustrated in FIG. 2.

FIG. 4 is a partial cross-sectional view illustrating the internal structure of the torque wrench 10. In order to illustrate the internal structure of the torque wrench 10, FIG. 4 illustrates the cross-section of only the casing 11 and a housing 198 of the rotation angle detector 19. As illustrated in FIG. 4, the casing 11 accommodates the head 12, a gain adjustment screw 14, a linkage 15, a slider 16, a spring guide 17, the torque value setting unit 18, and the rotation angle detector 19 which constitute the torque wrench 10. In addition, the casing 11 includes a turn detector 20 configured to detect the motion of the casing 11 with respect to the head 12.

The head 12 having an approximately rod shape includes an arm 122, a contact portion 123 and a motion detecting pin 125 which are accommodated in the casing 11, and the ratchet head 121 exposed to the outside of the casing 11. The casing 11 and the head 12 are pivotally supported by the head pin 13 provided at the boundary between the ratchet head 121 and the arm 122 to turn with respect to one another.

The head 12 is pivotally supported by the head pin 13 in the casing 11. Therefore, when the casing 11 turns around the head pin 13 in the rotating direction of the tightened member, the position of the arm 122 is changed relative to the casing 11.

The contact portion 123 is provided at one end of the arm 122 which is opposite to the ratchet head 121 side. When the casing 11 turns, the arm 122 contacts the inner wall of the casing 11, so that a clicking noise and a vibration are produced from the torque wrench 10. The contact portion 123 is provided at the position in which the casing 11 contacts the arm 122 when a load of the tightening operation is applied to the head 12.

The gain adjustment screw 14 is provided at the one end of the arm 122 of the head 12 to penetrate the head 12 in the width direction of the head 12. The gain adjustment screw 14 is provided to adjust the gain of the motion of the arm 122 when a tightening torque is applied to the torque wrench 10. The arm 122 is provided with the linkage 15 which is connected to the slider 16 by a link mechanism.

Like the contact portion 123, the motion detecting pin 125 is provided at the one end of the arm 122 opposite to the ratchet head 121 side in the longitudinal direction. The motion detecting pin 125 is provided to protrude in the thickness direction of the head 12, that is, the direction orthogonal to the page of FIG. 4. The motion detecting pin 125 is provided to allow the turn detector 20 to detect the turn of the casing 11.

One end of the slider 16 is connected to the arm 122 via the linkage 15, and the other end of the slider 16 is connected to the spring guide 17. The slider 16 moves in the casing 11 in the longitudinal direction when the casing 11 turns with respect to the head 12. In addition, the slider 16 includes a roller contacting the inner wall of the casing 11. The roller guides the movement of the slider 16 in the casing 11.

The spring guide 17 is an approximately cylindrical member. The cylindrical spring guide 17 is disposed in the casing 11 such that the casing 11 and the spring guide 17 have the same axis. The spring guide 17 guides the motion of a spring 181 of the torque value setting unit 18. The spring guide 17 includes a hole formed at the center of one flat surface of the spring guide. The other end of the slider 16 is inserted into the hole of the spring guide 17. The other flat surface of the spring guide 17 contacts one end of the spring 181.

The torque setting unit 18 includes the spring 181, a torque value display 182, a setting bolt 183, and a lock nut 184 which are provided in the casing 11. In addition, the torque value setting unit 18 includes a torque value setting grip 185 disposed outside the casing 11. The torque value setting unit 18 is configured to be able to set the preset torque value to any value by rotating the torque value setting grip 185 to change the compressive force of the spring 181.

The spring 181 is a compression spring which is compressed in the longitudinal direction of the torque wrench 10. The spring 181 may be, for example, a coil spring. As described above, the one end of the spring 181 contacts the other flat surface of the spring guide 17. The head 12 is pressed by the compressive force of the spring 181 via the linkage 15, the slider 16, and the spring guide 17. The spring 181 presses the head 12 pivotally supported by the head pin 13 in the casing 11, and therefore to restrict the casing 11 from turning with respect to the head 12.

The torque value display 182 having an approximately cylindrical shape is disposed in the casing 11. One end of the torque value display 182 contacts the other end of the spring 181, and the other end of the torque value display 182 is disposed to face the torque value setting grip 185. The torque value display 182 displays a scale indicating she preset torque value on its surface. A baffle (not illustrated) is attached to the inner wall of the casing 11. The torque value display 182 is provided to be able to slide with respect to the baffle in the axial direction of the torque wrench 10. The baffle prevents the torque value display 182 from turning in the casing 11, and allows the torque value display 182 to move in the casing 11 in the axial direction. By this means, it is possible to always read the scale of the torque value display 182 from a display window formed in the casing 11. Moreover, an internal thread is provided to penetrate the center of the torque value display 182 in the longitudinal direction.

The setting bolt 183 screws the internal thread of the torque value display 182. A flange of the setting bolt 183 engages with the lock nut 184.

The lock nut 184 having an approximately disk shape is fixed in the casing 11. A hole is formed in the center of the lock nut 184. The shaft of the setting bolt 183 is inserted into the hole of the lock nut 184.

The torque value setting grip 185 having an approximately cylindrical shape is provided at one end of the torque wrench 10. The torque value setting grip 185 functions as a rotating member. The torque value setting grip 185 is connected to the setting bolt 185 via the rotation angle detector 19 to rotate the setting bolt 183.

<Motion of Torque Wrench>

Now, the motion of the torque wrench 10 will be described. Here, a case in which the worker tightens the tightened member with a predetermined tightening torque value will be described as an example.

When the torque value setting grip 185 is rotated, the setting bolt 183 is rotated with the torque value setting grip 185. When the setting bolt 183 is rotated, the torque value display 182 moves in the casing 11 to compress the spring 181, so that the compressive force of the spring 181, that is, the preset torque value is changed. The worker checks that the torque value displayed on the torque value display 182 is the preset torque value, and stops the rotation of the torque value setting grip 185. After that, the worker performs the tightening operation.

Figure 5:
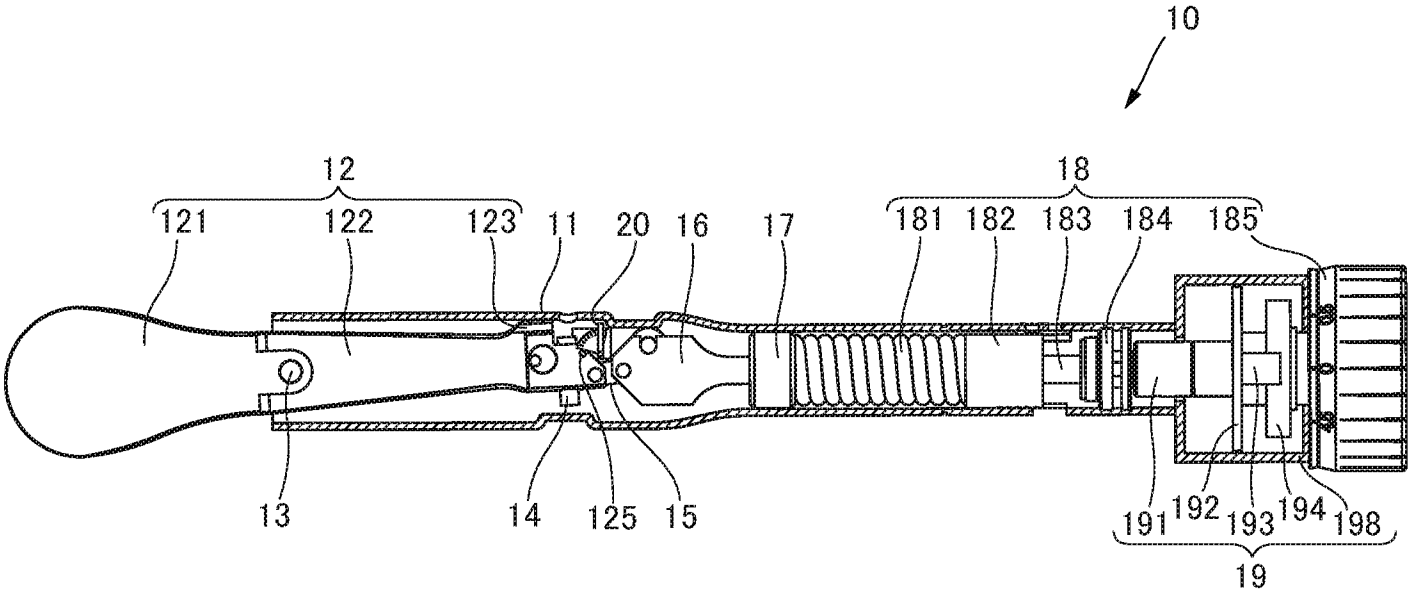
FIG. 5 is a partial cross-sectional view illustrating the internal structure of the torque wrench illustrated in FIG. 2 when a load applied to the torque wrench is equal to or greater than a preset torque value.

FIG. 5 is a partial cross-sectional view illustrating the internal structure of the torque wrench 10 when a load applied to the torque wrench 10 is equal to or greater than the preset torque value. As illustrated in FIG. 5, when the tightened member is tightened by the torque wrench 10, the compressive force is applied from the spring 181 to the head 12 via the slider 16 and the linkage 15. When the tightening torque reaches the preset torque value set by the torque value setting unit 18, a force generated by the tightening torque exceeds the compressive force of the spring 181. At this time, the casing 11 and the slider 16 are released from the restriction by the spring 181, so that the state of the torque wrench 10 illustrated in FIG. 4 is changed to the state illustrated in FIG. 5. To be more specific, the casing 11 is turned around the head pin 13 in the tightening direction (first direction), and contacts the arm 122 of the head 12, so that a clicking noise and a vibration are produced. With the clicking noise and the vibration, the torque wrench 10 notifies the worker that the tightening torque reaches the preset torque value. Upon perceiving the clicking noise and the vibration, the worker understands that the tightening torque reaches the preset torque value, and then stops applying the force to the torque wrench 10. As a result, the casing 11 is turned in the loosening direction (second direction).

The casing 11 is turned around the head pin 13, and therefore the inner wall of the casing 11 contacts the contact portion 123. When the inner wall of the casing 11 contacts the contact portion 123, the torque wrench 10 produces a clicking noise and a vibration.

<Configuration of Rotation Angle Detector>

The rotation angle detector 19 includes the housing 198, and a rotating shaft 191, a substrate 192, an encoder unit 193 and a disk 194 accommodated in the housing 198.

The rotating shaft 191 is connected to the setting bolt 183 and the torque value setting grip 185 illustrated in FIG. 4 to be able to cooperate with them. The rotating shaft 191 transfers the torque from the torque value setting grip 185 rotated by the worker to the setting bolt 183.

The substrate 192 is a member on which electronic components such as the encoder unit 193, a calculation unit 31, and a communication unit 32 can be placed. A well-known electronic circuit substrate such as a printed circuit board may be used as the substrate 192. The rotating shaft 191 is inserted into a hole formed in the substrate 192.

The encoder unit 193 includes a light emitting element 193*a*, a light receiving element 193*b*, and a signal processor 193*c* described later. As the encoder unit 193, an absolute encoder or an incremental encoder, which is well-known as a rotary encoder, may be used.

<Functional Block of Rotation Angle Detector>

Figure 6:
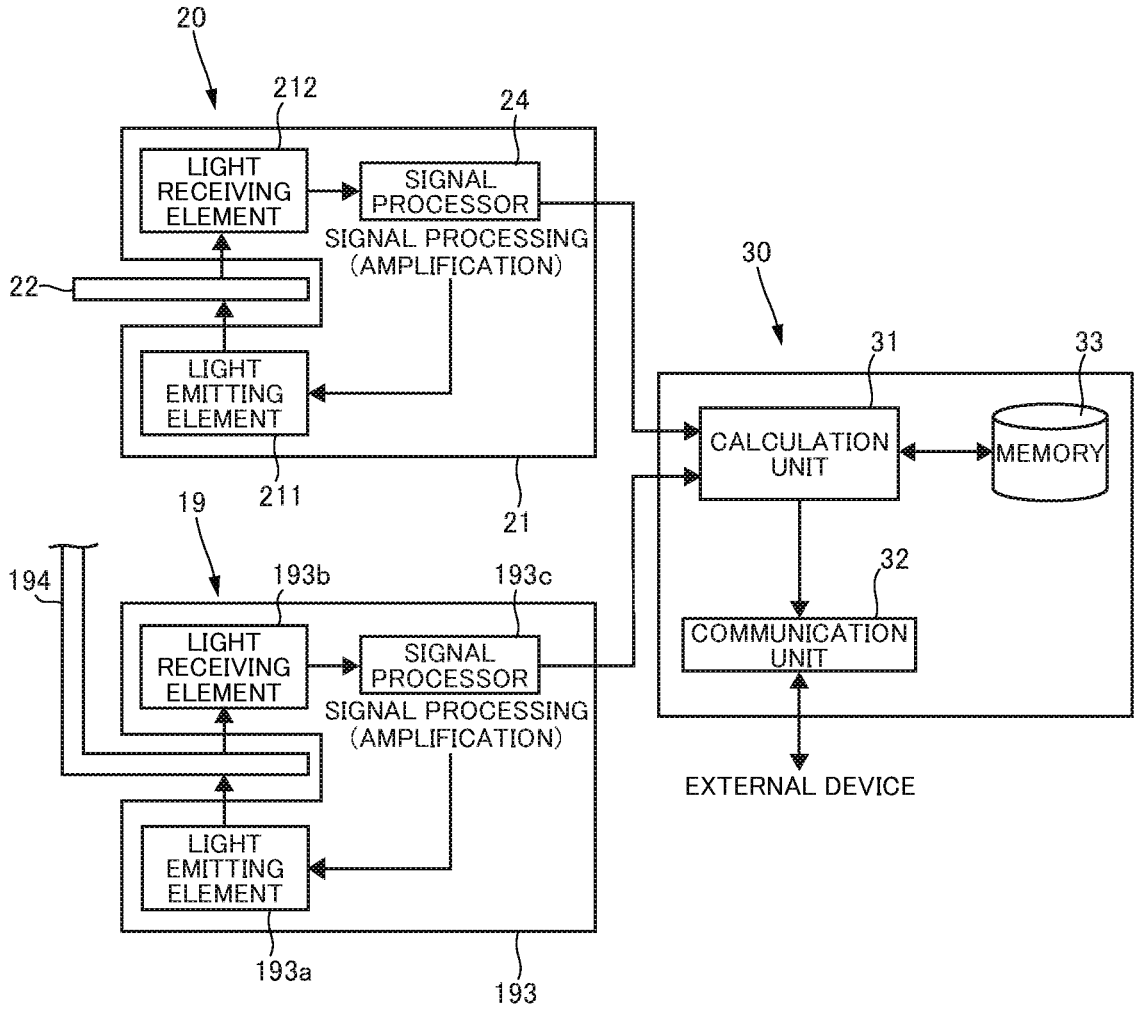
FIG. 6 is a functional block diagram illustrating a rotation angle detector and a turn detector of the torque wrench illustrated in FIG. 2.

FIG. 6 is a block diagram illustrating the rotation angle detector 19 and the turn detector 20 of the torque wrench 10. Here, the function of the turn detector 20 will be described later. As illustrated in FIG. 6, the rotation angle detector 19 is connected to an MCU (micro control unit) 30. The MCU 30 performs the calculation of the preset torque set by the torque value setting unit 18 of the torque wrench 10, and the calculation for the turning motion of the casing 11 with respect to the head 12 detected by the turn detector 20 described later.

Next, components constituting the rotation angle detector 19 will be described. As the light emitting element 193*a*, various types of light sources such as a light emitting diode and a laser diode may be used. The light emitting element 193*a* functions as a light emitter configured to emit light to the disk 194.

As the light receiving element 193*b*, for example, a photo diode may be used. The light receiving element 193*b* functions as a light receiver configured to receive part of the light emitted from the light emitting element 193*a*, which has not been varied, for example, has not been reflected, blocked or refracted by the disk 194. The light receiving element 193*b* outputs a light reception signal based on the received light.

The signal processor 193*c* performs signal processing, for example, amplifies the light reception signal outputted from the light receiving element 193*b*, detects the rotation angle of the setting bolt 183, and outputs information on the rotation angle (hereinafter "rotation angle information") which is electronic information based on the detected rotation angle of the setting bolt 183 to the calculation unit 31. In addition, in order to save the electric power and stabilize the motion of the light emitting element 193*a*, the signal processor 193*c* may control the electric power to drive the light emitting element 193*a* and the motion of the light emitting element 193*a*, based on, for example, the amount of light received.

The rotating shaft 191 penetrates the center of the disk 194, and rotates with the disk 194. The disk 194 functions as a light reception varying unit configured to vary the light receiving state of the light receiving element 193*b*.

The disk 194 varies the light receiving state of the light receiving element 193*b* by preventing the light from the light emitting element 193*a* from passing therethrough. The disk 194 having an approximately cup-like shape includes a disk-shaped flat plate, a side portion provided around the outer periphery of the flat plate, and light permeable portions formed on the side portion. The flat plate and the side portion of the disk 194 have light impermeability (light blocking effect). The light permeable portions are formed as slits on the side portion at regular intervals to allow the light from the light emitting element 193*a* to pass therethrough.

Here, the disk 194 is not limited to the above-described light permeable type having the light permeable portions. For example, a prism is applicable to refract the light from the light emitting element 193*a*, so that it is possible to vary the light receiving state of the light receiving element 193*b*.

<Calculation Based on Rotation Angle Information>

Next, the calculation of the preset torque value performed by the calculation unit 31 based on the rotation angle information outputted from the rotation angle detector 19 will be described. The calculation unit 31 calculates the rotation angle (the number of rotations and the amount of rotation) of the setting bolt 183, based on the signal outputted from the signal processor 193*c* of the encoder unit 193. In addition, the calculation unit 31 calculates the preset torque value set by the torque value setting grip 185, based on the rotation angle of the setting bolt 183. The calculation unit 31 pays attention to the change in the compressive force of the spring 181 depending on the rotation angle of the setting bolt 183, and calculates the preset torque value set by the torque value setting unit 18, based on the detected rotation angle of the setting bolt 183.

The calculation unit 31 calculates the preset torque value by using information indicating the correlation between the rotation angle stored in a memory 33 and the preset torque value (for example, a conversion formula or a data table for calculating the preset torque value based on the rotation angle), and outputs the calculated preset torque value. The calculation unit 31 may output the calculated preset torque value associated with the information on the time and date of the work, the worker and so forth.

<Configuration of Turn Detector (1)>

The turn detector 20 is provided in the vicinity of the motion detecting pin 125, that is, one end of the arm 122 opposite to the ratchet head 121 side in the longitudinal direction. The turn detector 20 is fixed to the casing 11 to detect the motion of the casing 11 with respect to the head 12, specifically, the arm 122 of the head 12. The turn detector 20 may be provided in the casing 11. At least part of the turn detector 20 may be exposed from the casing 11. In this case, the exposed part of the turn detector 20 may be covered with a cover (not illustrated).

Figure 7:
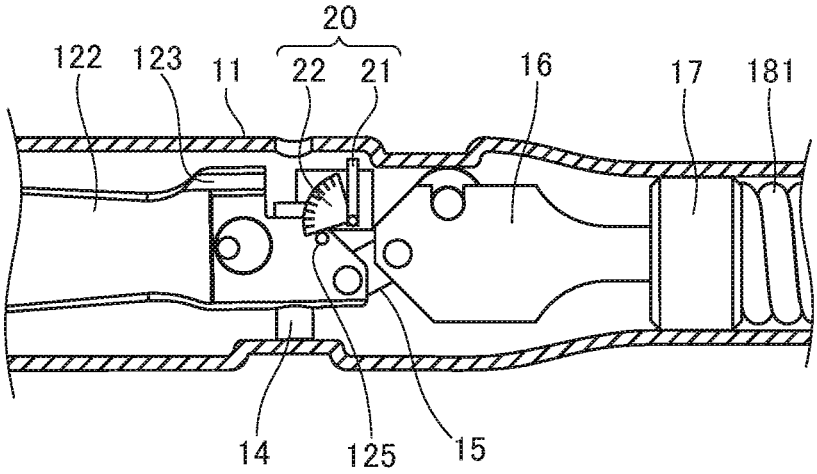
FIG. 7 is a schematic view illustrating the turn detector of the torque wrench illustrated in FIG. 2.

FIG. 7 is a schematic view illustrating the turn detector 20 of the torque wrench 10. As illustrated in FIG. 7, the turn detector 20 includes an encoder unit 21 including a light emitting element and a light receiving element, and a detection lever 22. The turn detector 20 detects information on the turn (the turn direction and the amount of turn) of the casing 11, based on the variation in the light receiving state of the light receiving element of the encoder unit 21, that is, the amount of light received by the light receiving element of the encoder unit 21.

<Functional Block of Turn Detector>

As illustrated in FIG. 6, the turn detector 20 is connected to the MCU 30, like the rotation angle detector 19. The MCU 30 performs the calculation for the turning motion of the casing 11 of the torque wrench 10.

Next, components constituting the turn detector 20 will be described. As a light emitting element 211, various types of light sources such as a light emitting diode and a laser diode may be used. The light emitting element 211 functions as a light emitter configured to emit light to a light receiving element 212 and the detection lever 22.

As the light receiving element 212, for example, a photo diode may be used. The light receiving element 212 is disposed to be able to receive the light from the light emitting element 211, for example, at a position facing the light emitting element 211. The light receiving element 212 functions as a light receiver configured to receive part of the light emitted from the light emitting element 211, which has been varied, for example, reflected, blocked, or refracted by the detection lever 22. The light receiving element 212 outputs a light reception signal based on the received light.

The detection lever 22 is a light permeable member made of, for example, acrylic, provided between the light emitting element 211 and the light receiving element 212. A number of prisms are provided on the side surface of the detection lever 22 at regular intervals, and configured to refract the light from the light emitting element 212 and pass the light. therethrough.

Figure 8:
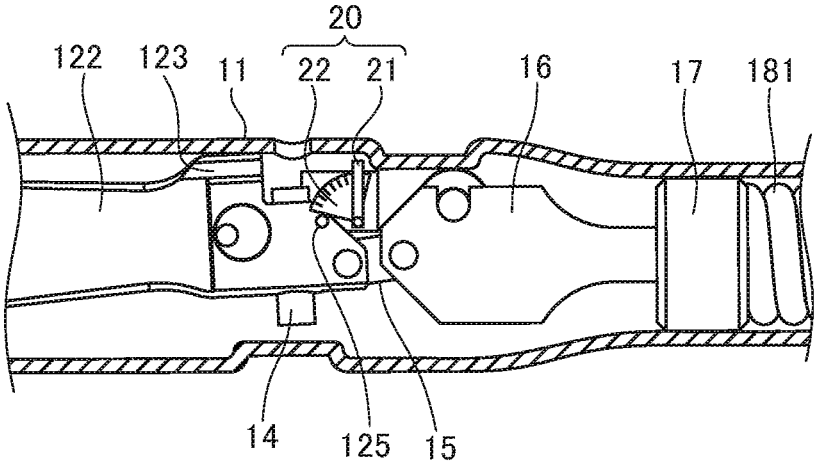
FIG. 8 is a schematic view illustrating the turn detector when a load applied to the torque wrench is equal to or greater than a preset torque value of the torque wrench illustrated in FIG. 2.

FIG. 8 is a schematic view illustrating the turn detector 20 when a load applied to the torque wrench 10 is equal to or greater than the preset torque value. As illustrated in FIG. 8, the detection lever 22 turns around a pivot. By this means, the detection lever 22 varies the light receiving state of the light receiving element 212 depending on the positions of the priors when the light passes through the prisms. That is, the detection lever 22 functions as a light reception varying unit configured to vary the light receiving state of the light receiving element 212, depending on the differences in position of the prisms when the light emitted from the light emitting element 211 passes through the detection lever 22 and is refracted.

The detection lever 22 contacts the motion detecting pin 125, and therefore synchronizes with the motion of the head 12 having the motion detecting pin 125. That is, the detection lever 22 synchronizes with the motion of the motion detecting pin 125, and therefore the turn detector 20 can acquire the information on the turning motion such as the amount of turn, the turn direction, and the turn angle of the casing 11 with respect to the head 12.

Here, the detection lever 22 not limited to the above-described type having prisms, but may vary the light receiving state of the light receiving element 212 by, for example, providing a light permeable member and a light impermeable member to block the light from the light emitting element 193*a*.

A signal processor 24 processes, for example, amplifies the light reception signal outputted from the light receiving element 212. At this time, the signal processor 24 detects an electric signal indicating the amount of turn of the detection lever 22, based on the difference in the light receiving state caused by the detection lever 22. The signal processor 24 outputs the electric signal as electric information on the amount of turn based on the detected amount of turn of the detection lever 22, to the calculation unit 31. Moreover, in order to save the electric power and stabilize the motion of the light emitting element 211, the signal processor 24 may control the electric power to drive the light emitting element 211 and the motion of the light emitting element 211, based on, for example, the amount of light received.

The calculation unit 31 can calculate the amount of turn, the turn angle, and the turn direction of the casing 11 with respect to the head 12 having the motion detecting pin 125 contacting the detection lever 22, based on the electric signal indicating the amount of turn of the detection lever 22, which is acquired from the signal processor 14. That is, the calculation unit 31 can identify the amount of turn of the casing 11, based on the electric signal indicating the amount of turn of the detection lever 22.

The communication unit 32 transmits information about the tightening operation to tighten the tightened member, including either the data on the preset torque value outputted from the calculation unit 31 or the rotation angle information, to an external device. In addition, the communication unit 32 transmits the electric signal indicating the amount of turn of the casing 11 to the external device. Here, examples of the external device may be, for example, an information processor such as the computer 101 of the tool station 100 in the tightening operation analysis system 1, and the server S configured to manage data on the preset torque value. The communication path of the communication unit 32 may be wireless or wired. Moreover, the type of the communication format of the communication unit 32 with the external device is not limited. For example, Bluetooth (trademark), infrared communication, WAN (wide area network), and LAN (local area network) are applicable.

As described above, the turn detector 20 can acquire the amount of turn, the turn direction, and the turn angle based on the information on the amount of turn of the casing 11, and therefore the torque wrench 10 can correctly recognize the tuning motion. In addition, the torque wrench 10 can improve the traceability of the tightening operation and the analysis of the work, by using the information on the amount of turn, the turn direction, and the turn angle of the turning motion of the casing 11 which is acquired by the turn detector 20.

Here, the above-described calculation performed by the MCU 30 may be performed by the external device such as the computer 101, instead of the torque wrench 10. In this case, the rotation angle information outputted from the rotation angle detector 19 and the information on the amount of turn outputted from the turn detector 20 are transmitted from the communication unit 32 to the computer 101. Then, the computer 101 may perform the calculation of the preset torque, and the calculation for the turning motion of the casing 11. In this case, the computer may output the result of the calculation, or transmit the result of the calculation to the torque wrench 10, and the torque wrench 10 may output the result of the calculation. By this means, it is possible to realize the tightening operation analysis system 1 of the torque wrench 10 with the external computer 101.

<Configuration of Tool Station>

Figure 9:
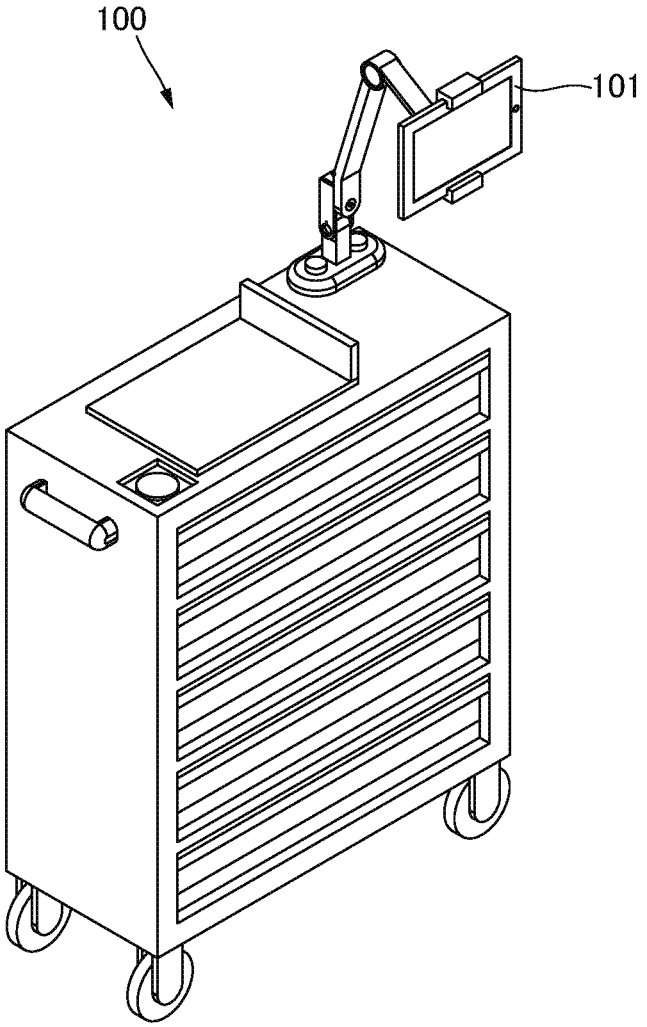
FIG. 9 is a perspective view illustrating a tool station as a tightening operation analysis apparatus according to an embodiment of the present invention.

FIG. 9 is a perspective view illustrating the tool station 100 as a tightening operation analysis apparatus according to an embodiment of the present invention.

The tool station 100 is a roller cabinet having a plurality of drawers to store tools. The tablet computer 101 is provided on the tool station 100.

Figure 10:
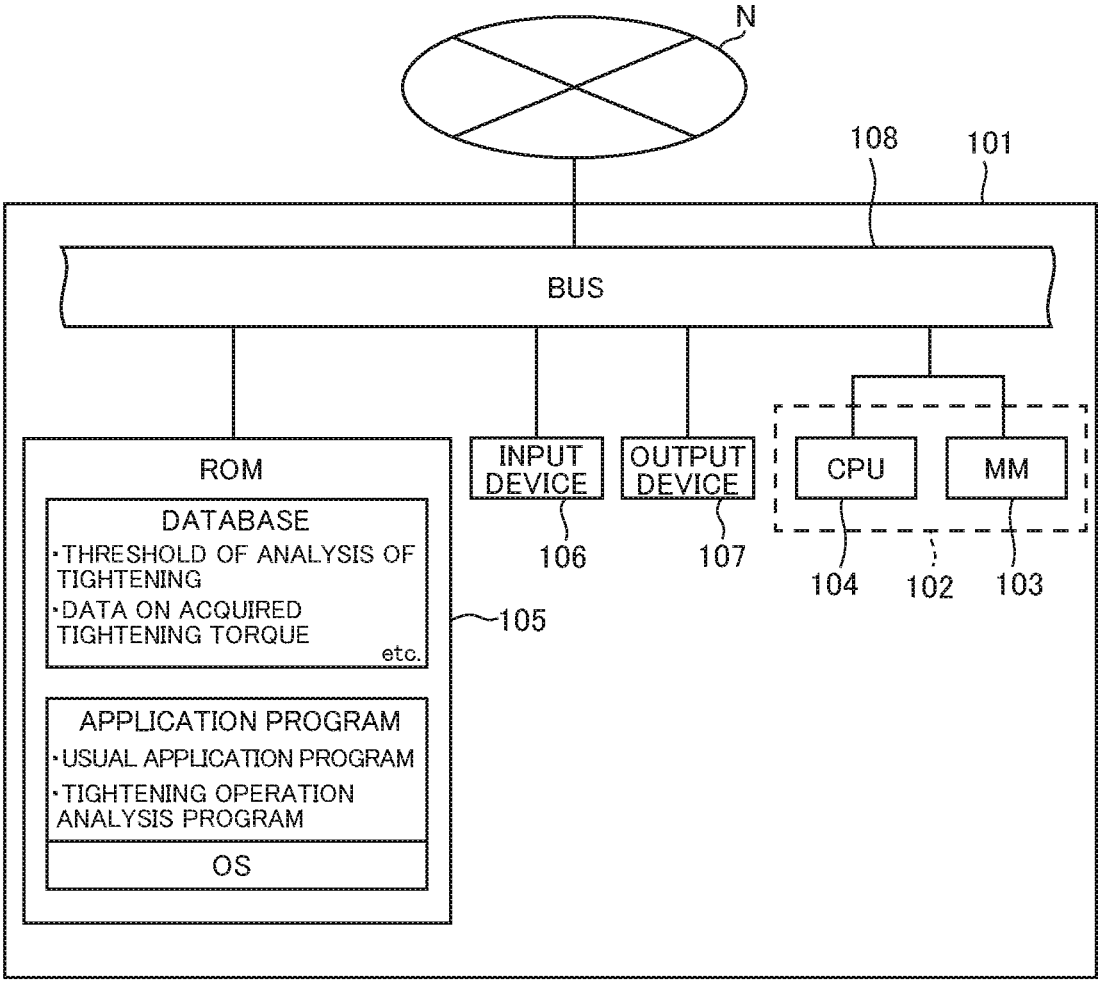
FIG. 10 is a functional block diagram illustrating a computer of the tool station illustrated in FIG. 9.

FIG. 10 is a functional block diagram illustrating the computer 101. The computer 101 includes a calculation unit 102, a secondary memory 105, an input device 106, and an output device 107.

The calculation unit 102 is constituted by a CPU (central processing unit) 104 and a MM (main memory) 103, and performs processing according to an application program including a tightening operation analysis program.

The secondary memory 105 is connected to the calculation unit 102 via a bus 108. As the secondary memory 105, a mass storage medium such as a ROM (read only memory) and a hard disk drive may be used. An operating system required to allow the computer 101 to function normally is installed in the secondary memory 105. The tightening operation analysis program which is executable by the computer is also installed in the secondary memory 105. This tightening operation analysis program is created to realize the tightening operation analysis apparatus that performs the tightening operation analysis method according to the present embodiment. Moreover, another application program commonly used may be installed in the second memory 105.

The tablet computer 101 is an example of various information processing terminals. The CPU 104 of the tablet computer 101 loads (reads) the tightening operation analysis program from the secondary memory 105 into the MM 103 as necessary, and sequentially executes the program, so that the computer 101 performs each process described later in the tightening operation analysis apparatus. Processes performed in the tightening operation analysis apparatus may include, for example, a process performed by the tightening operation analysis method, a process of calculating the preset torque value of the torque value setting unit 18, and a process of detecting the tightened member being tightened.

The input device 106 may be a tach panel or a camera, which is used by the worker to input various pieces of information. In addition, the input device 106 may be a keyboard, or a pointing device such as a mouse (not illustrated). The output device 107 is configured to output various pieces of information to the worker, and may be, for example, a display superposed on the touch panel, and a printer (not illustrated).

<Process of Analyzing Tightening Operation>

Now, a process of analyzing the tightening operation will be described. This process is performed by the calculation unit 102 of the computer 101, based on the information on the amount of turn outputted from the turn detector 20. The calculation unit 102 judges the turning motion of the casing 11, based on the signal outputted from the signal processor 24 of the turn detector 20. Then, the calculation unit 102 performs a tightening operation analysis method according to the present embodiment, based on the turning motion of the casing 11. To be more specific, the calculation unit 102 determines whether the tightening torque to tighten the tightened member during the tightening operation is equal to or greater than the preset torque value ("overtorque"), as a process of the tightening operation analysis method.

Figure 11:
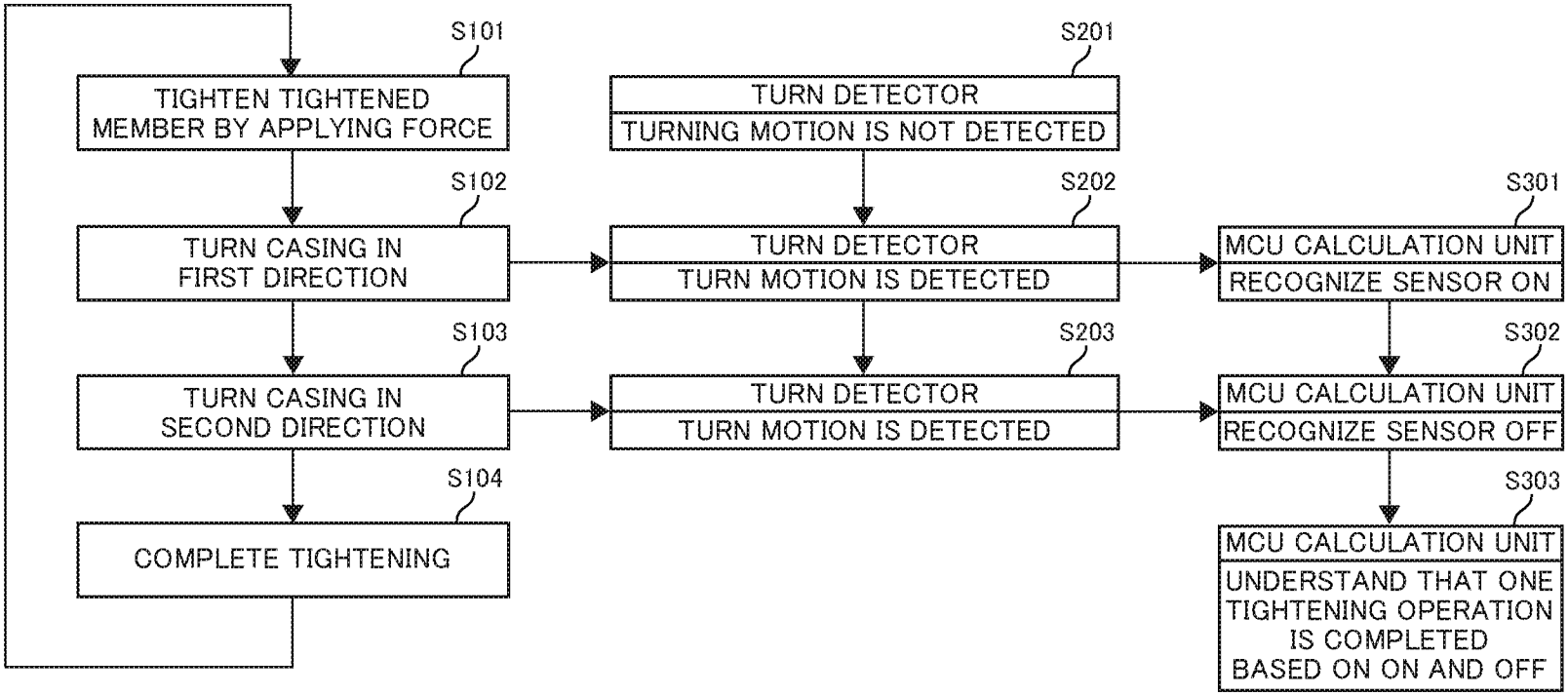
FIG. 11 is a flowchart illustrating an exemplary process of a tightening operation analysis method performed by the computer illustrated in FIG. 10.

FIG. 11 is a flowchart illustrating an exemplary process of the tightening operation analysis method performed by the computer 101. FIG. 11 illustrates a process having the following steps of the tightening operation analysis method when the worker uses the torque wrench 10 to tighten a tightened member with the tightening torque of the preset torque value.

When the tightened member is tightened with the torque wrench 10 by applying the force of the worker (S101), the head 12 and the casing 11 of the torque wrench 10 are located in the positions in the state where the torque of the torque wrench 10 does not exceed the preset torque value as illustrated in FIG. 4 and FIG. 7. At this time, the turn detector 20 does not detect the turning motion of the casing 11, and therefore not output information on the amount of turn (S201).

As illustrated in FIG. 5 and FIG. 8, when the load applied to the torque wrench 10 is equal to or greater than the preset torque value, the casing 11 and the slider 16 are released from the restriction by the spring 181 and moves from the state illustrated in FIG. 4 to the state illustrated in FIG. 5. In this state, the casing 11 turns around the head pin 13 with respect to the arm 122 of the head 12 in the first direction. The motion detecting pin 125 provided on the arm 122 is also moved with respect to the casing 11 (S102).

At this time, the detection lever 22 of the turn detector 20 is pressed by the motion detecting pin 125 as illustrated in FIG. 8, and therefore the light receiving state of the light receiving element 212 attached to the casing 11 is varied. The turn detector 20 senses the motion detecting pin 125, and therefore detects the turning motion of the casing 11. If the amount of turn of the casing 11 is equal to or greater than a predetermined value, the calculation unit 31 determines that the casing 11 is turned with respect to the head 12 (bending state).

The information on the amount of turn is outputted from the turn detector 20 to the computer 101 via the signal processor 24 (S202). The calculation unit. 102 of the computer 101 recognizes that the positions of the casing 11 and the head 12 have moved from the initial positions illustrated in FIG. 4 to the positions after the casing 11 has turned as illustrated in FIG. 5 (S301).

After the casing 11 is turned around the head pin 13 with respect to the arm 122 of the head 12 in the first direction and released from the force of the worker, the casing 11 turns in the loosening direction (second direction). The casing 11 is returned from the position as illustrated in FIGS. 5 and 8 to the position as illustrated in FIG. 4 and FIG. 7 (S103).

At this time, the detection lever 22 of the turn detector 20 is also returned to the position illustrated in FIG. 7, and therefore the light receiving state of the light receiving element 212 is varied, so that the turn detector 20 can detect the turning motion of the casing 11 (S203).

The calculation unit 102 recognizes that the positional relationship between the casing 11 and the head 12 comes back to the original state illustrated in FIG. 4, based on the information on the amount of turn outputted from the turn detector 20 (S302).

When judging that the casing 11 has turned with respect to the head 12 in both the first direction and the second direction, based on the information on the amount of turn received from the turn detector 20, the calculation unit 102 determines that one tightening operation is completed (S303). Here, after the step of S303, the calculation unit 102 may perform a step of storing a record (count) of the completion of the tightening operation in the secondary memory 105.

By recognizing the tuning motion of the casing 11 of the torque wrench 10, the worker understands that the tightening torque to tighten the tightened member reaches the preset torque value, and complete the tightening operation by using the torque wrench 10 (S104).

Figure 12:
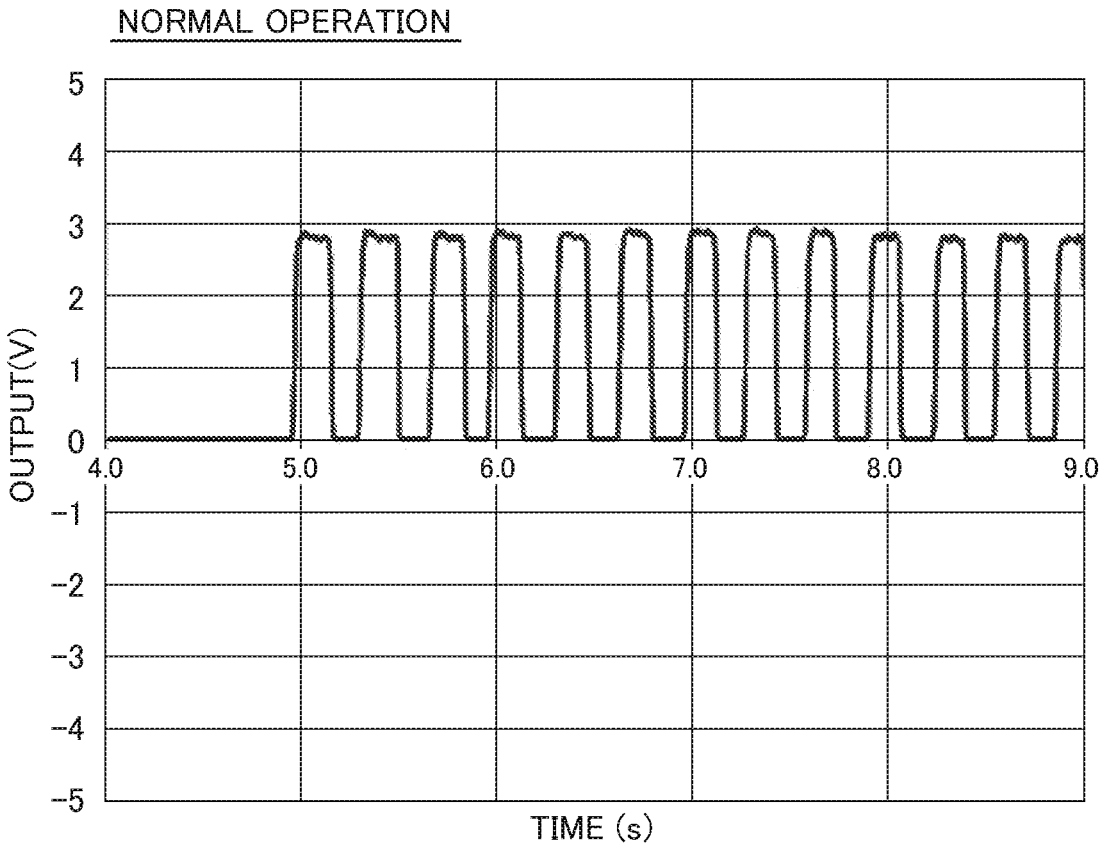
FIG. 12 illustrates an exemplary waveform outputted in the process of the tightening operation analysis method when the tightening operation with the preset torque value is performed.

FIG. 12 illustrates an exemplary waveform outputted in the process of the tightening operation analysis method when the tightening operation with the preset torque value is performed. The waveform outputted in the process of the tightening operation analysis method is an example of the result of analysis of the load condition of the tightened member during the tightening operation. In FIG. 12, when the output waveform, that is, the voltage of an electric signal is 0V, it is indicated that the casing 11 is located in the initial position, which is recognized by the calculation unit 102 based on the information on the amount of turn outputted from the turn detector 20. Hereinafter, this state may be referred to as "OFF state."

In addition, when the output waveform, that is, the voltage of the electric signal is 3V, it is indicated that the casing 11 is in the bending state illustrated in FIG. 5, which is recognized by the calculation unit 102 based on the information on the amount of turn outputted from the turn detector 20. Hereinafter, this state may be referred to as "ON state."

In FIG. 12, during the tightening operation by using the torque wrench 10, the worker stops applying the tightening torque just after the tightening torque reaches the preset torque value. Therefore, during the tightening operation illustrated in FIG. 12, a period of time until the head 12 11 has turned in the second direction after turning in the first direction, that is, an elapsed time after the head 12 is placed in "ON state" is shortened. When an excessive tightening torque (overtorque) is not applied during the tightening operation, a period of time for which the information on the amount of turn is outputted is short as indicated by the output waveform from the turn detector 20. In FIG. 12, the period of time for which the information on the amount of turn is outputted once is, for example, 0.2 seconds. The output waveform as illustrated in FIG. 12 where each of the periods of time for which the information on the amount of turn is outputted is short (nearly equal to the threshold) indicates that the tightening operation is performed in an appropriate manner.

Figure 13:
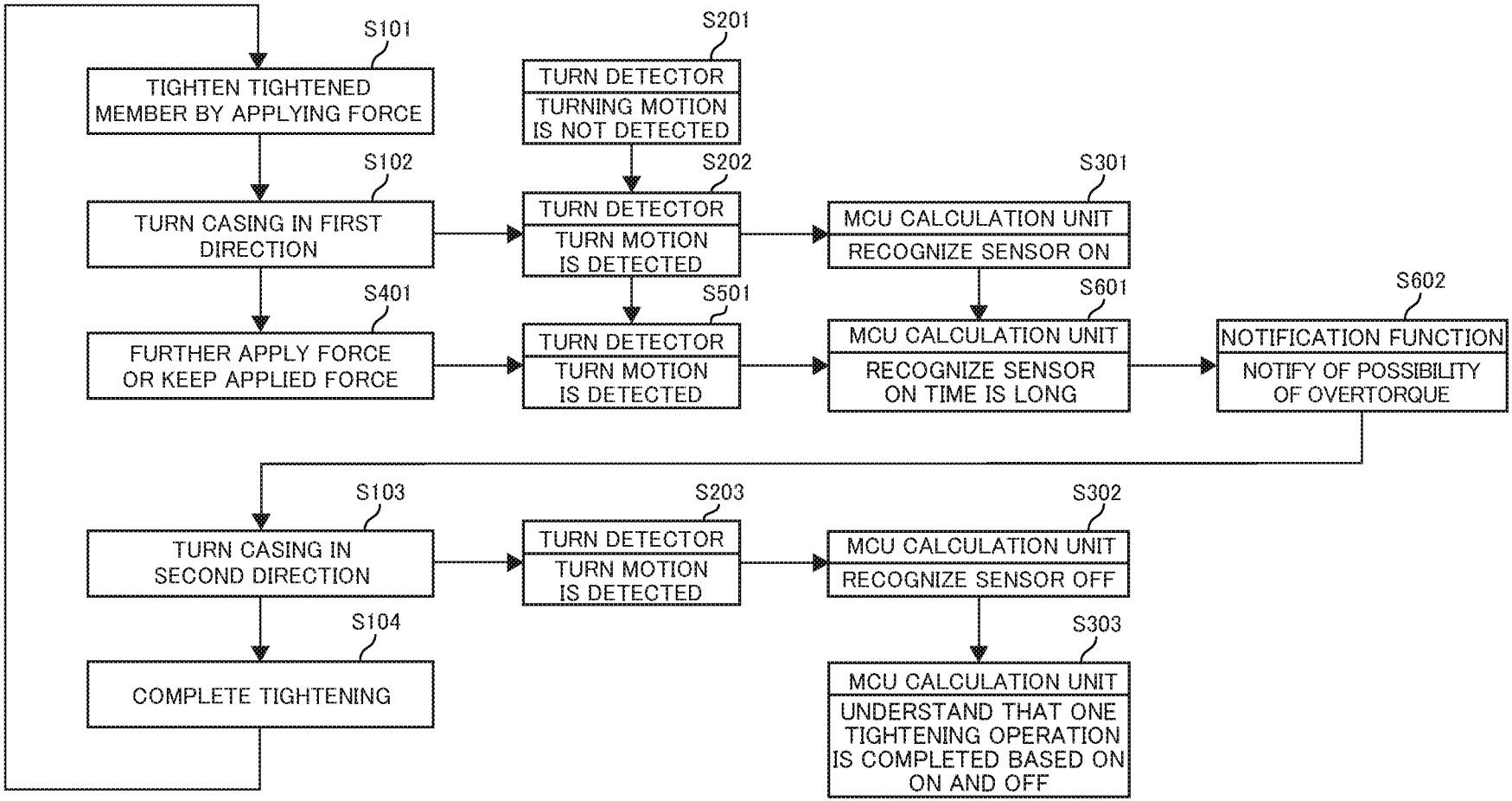
FIG. 13 is a flowchart illustrating another exemplary process of the tightening operation analysis method performed by the computer illustrated in FIG. 10.

FIG. 13 is a flowchart illustrating another exemplary process of the tightening operation analysis method performed by the computer 101. The process of the tightening operation analysis method illustrated in FIG. 13 is different from that illustrated in FIG. 11 in that the tightened member is tightened with the torque wrench 10 by applying the force of the worker with a tightening torque greater than the preset torque value (overtorque). Hereinafter, only the steps different from those in FIG. 11 will be described.

After recognizing the motion of the casing 11 based on the signal outputted from the turn detector 20 in the step S301, the worker further applies the force (tightening torque) to the torque wrench 10 or keeps the applied force (S401).

In this case, even though the arm 122 of the head 12 has turned around the head pin 13 in the first direction, the tightening torque with an excessive torque value is being applied to the torque wrench 10. Therefore, the turn detector 20 continues to output the information on the amount of turn (S501).

After receiving the information on the amount of turn in the step S301, the calculation unit 102 continues to receive the information on the amount in response to the step S501. Then, the calculation unit 102 determines whether the period of time for receiving the information on the amount of turn is longer than a predetermined threshold of the period of time for receiving the information on the amount of turn stored in the secondary memory 105 (S601). The threshold may be, for example, the period of time for receiving the information on the amount of turn (0.2 seconds) indicated by the output waveform illustrated in FIG. 12.

When the period of time for receiving the information on the amount of turn, that is, the duration time of the bending state of the casing 11 is longer than the threshold, the calculation unit 102 determines that the tightening torque of the tightening operation may be equal to or greater than the preset torque value, that is, overtorque, and notifies the worker of the possibility of overtorque (S602). This step of S602 is an example of the step of outputting the result of analysis of the tightening operation. To notify the worker of the possibility of overtorque, for example, a notification signal may be transmitted to the torque wrench 10 to prompt the worker to perceive something in response to the signal, by using a vibration generator or sound generator provided in the torque wrench 10. Alternatively, to notify the worker of the possibility of overtorque, an image or a sound may be outputted by the output device 107 such as a display and a speaker of the computer 101.

Upon perceiving the possibility of overtorque by a notification function of the step S602, the worker stops applying the force to the torque wrench 10, and completes the tightening operation (S104). After the worker stops applying the force to the torque wrench 10, the turn detector 20 of the torque wrench 10 and the computer 101 of the tool station 100 perform the steps following the step S103, and ends the process.

Figure 14:
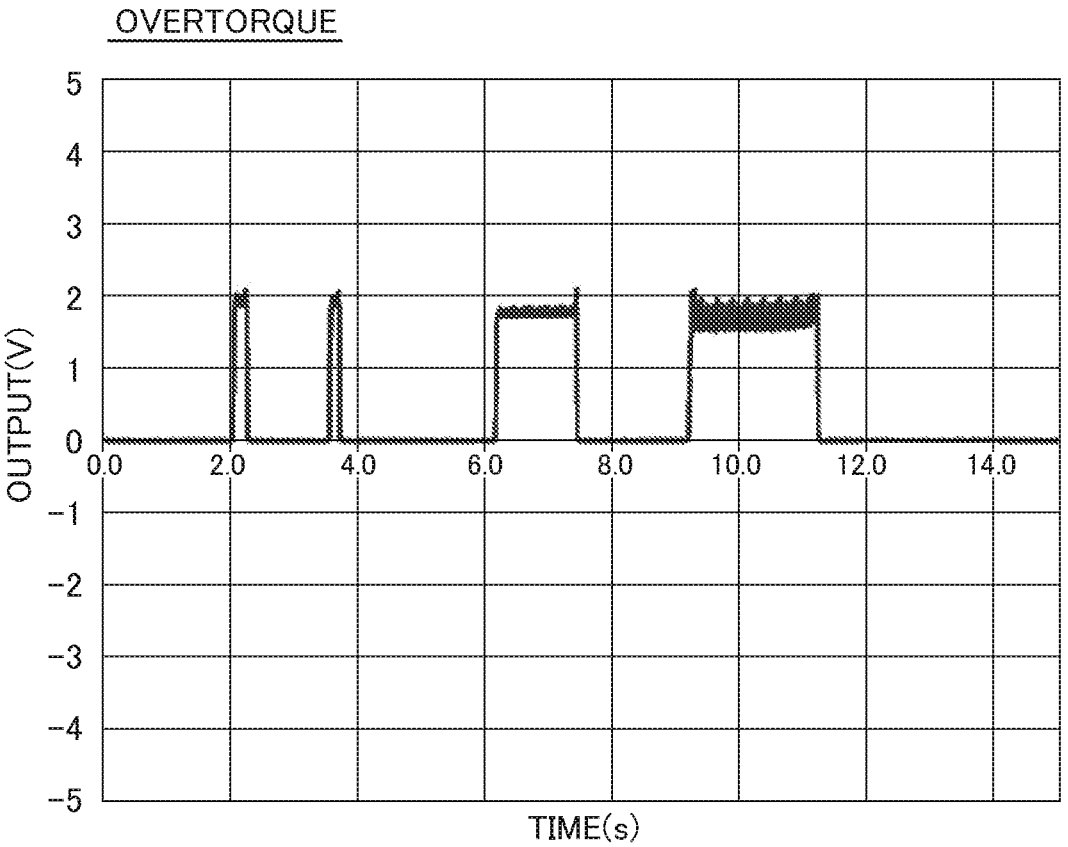
FIG. 14 is an exemplary waveform outputted in the process of the tightening operation analysis method when the tightening operation with overtorque is performed.

FIG. 14 is an exemplary waveform outputted in the process of the tightening operation analysis method when the tightening operation with overtorque is performed. The waveform illustrated in FIG. 14 is another example of the result of analysis of the load condition of the tightened member during the tightening operation. In FIG. 14, the correspondence relationship between the output waveform and the position of the casing 11 in the initial state and the bending state is the same as that illustrated in FIG. 12.

As illustrated in FIG. 14, during the tightening operation by using the torque wrench 10, the worker continues to apply the tightening torque equal to or greater than the preset torque value after the tightening torque reaches the preset torque value. Therefore, the period of time until the positions of the casing 11 and the head 12 return to the initial positions via the bending state is longer than the period of time (0.2 seconds) illustrated in FIG. 12.

In the waveform illustrated in FIG. 14, long periods of time until the positions of the casing 11 and the head 12 return to the initial positions from the bending state represent an example of load conditions of the tightened member during the tightening operation. That is, when the tightening operation is performed with an excessive tightening torque (overtorque), the period of time until the positions of the casing 11 and the head 12 return to the initial positions from the bending state once is lengthened in the output waveform from the turn detector 20. The output waveform as illustrated in FIG. 14 where the period of time until the positions of the casing 11 and the head 12 return to the initial positions from the bending state once longer than the threshold indicates that the tightening operation is not performed in an appropriate manner. Moreover, it is understood from FIG. 14 that the periods of time until the positions of the casing 11 and the head 12 return to the initial positions from the bending state are not uniform. Therefore, the computer 101 may analyze the tightening operation based on the period of time for ON state or OFF state.

As described above, the computer 101 can acquire the period of time for which the worker applies the tightening torque to the torque wrench 10, based on the information indicating the turning motion of the casing 11 acquired by the turn detector 20 of the torque wrench 10. Then, the computer 101 can analyze whether the tightening torque equal to or greater than the preset torque value is applied during the tightening operation, based on the period of time for which tightening torque is applied to the torque wrench 10. Therefore, the computer 101 can accurately analyze the tightening operation with a simple configuration. Moreover, the computer 101 can improve the traceability of the tightening operation and the analysis of the work, by using the information on the turning motion of the casing 11 acquired by the turn detector 20.

Here, with the present embodiment, the tightening operation analysis apparatus has been described as the computer 101 of the tool station 100 provided separately from the torque wrench 10. However, this is by no means limiting. For example, the MCU 30 of the torque wrench 10 may perform the tightening operation analysis program according to the present invention, so that it is possible to realize a tightening tool capable of executing the tightening operation analysis method according to the present invention. Moreover, the computer 101 as the tightening operation analysis apparatus according to the present invention may communicate directly with the communication unit 32 of the torque wrench 10 without the network N.

Figure 15:
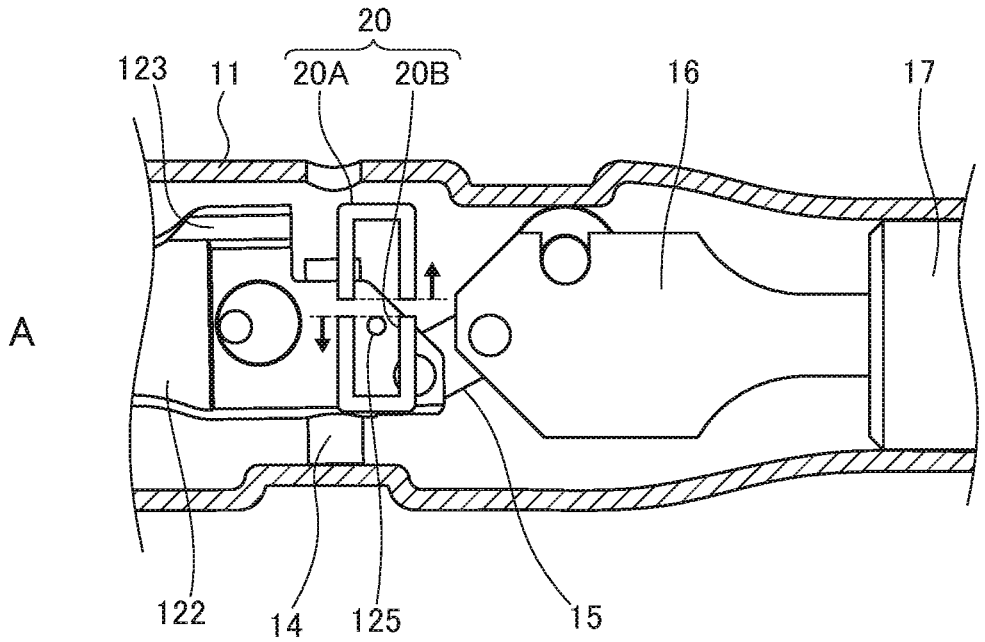
FIG. 15 is a schematic view illustrating another example of the turn detector of the torque wrench illustrated in FIG. 2.
Figure 15:
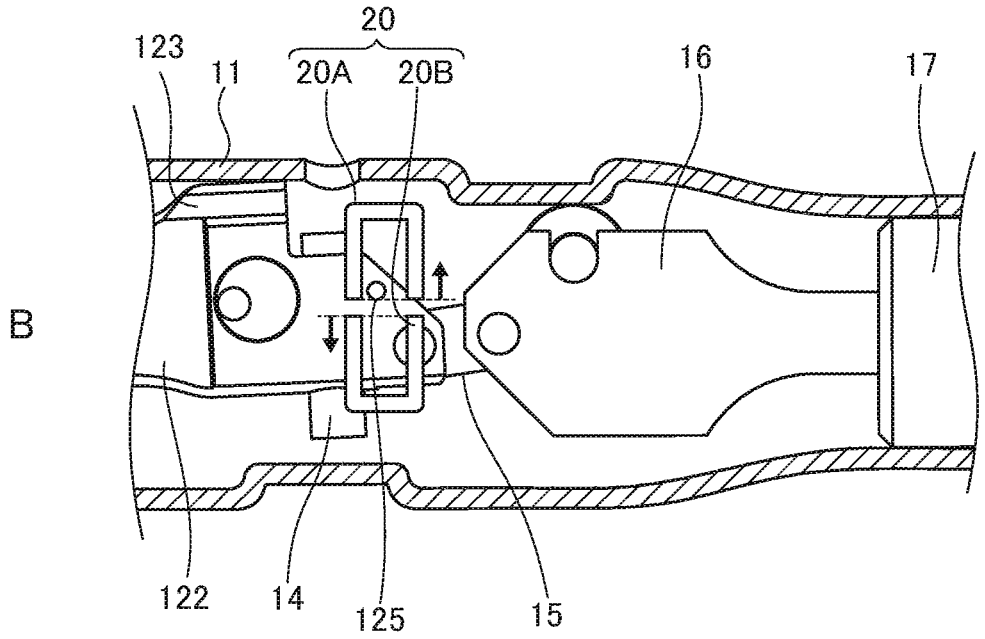

FIG. 15 is a schematic view illustrating another example of the turn detector 20 of the torque wrench 10. As illustrated in FIG. 15, the turn detector 20 may be composed of a first turn detector 20A configured to detect the turn of the casing 11 in the first direction, and a second turn detector 20 configured to detect the turn of the casing 11 in the second direction, which are light emitting and receiving devices.

FIG. 15A illustrates the first turn detector 20A and the second turn detector 20B of the torque wrench 10 when the load applied to the torque wrench 10 is lower than the preset torque value. As illustrated in FIG. 15A, when the load is lower than the preset torque value, the motion detecting pin 125 is located within the detectable range of the second turn detector 20B.

FIG. 15B illustrates the first turn detector 20A and the second turn detector 20B when the load of the torque wrench 10 is equal to or greater than the preset torque value. When the load applied to the torque wrench 10 is equal to or greater than the preset torque value, the casing 11 turns in the first direction, so that the motion detecting pin 125 gets out of the detectable range of the second turn detector 20B and falls within the detectable range of the first turn detector 20A. At this time, the light receiving state of the light receiving element of the second turn detector 20B is varied, and therefore the second turn detector 20B outputs a signal.

After that, the casing 11 turns in the second direction to move from the state illustrated in FIG. 15B back to the state illustrated in FIG. 15A. At this time, the motion detecting pin 125 moves from The detectable range of the first turn detector 20A to the detectable range of the second turn detector 20B. The light receiving state of the light receiving element of the first turn detector 20A is varied during the emission of the light, and therefore the first turn detector 20A outputs a signal. The calculation unit 102 can calculate the turn direction of the casing 11 with respect to the head 12, based on the signals outputted from the first turn detector 20A and the second turn detector 20B. In addition, the calculation unit 102 can calculate the amount of turn and the turn angle of the casing 11 with respect to the head 12 from the outputted signal, based on the information on the detection ranges of the first turn detector 20A and the second turn detector 20B in association with the amount of turn and the turn angle of the casing 11.

As described above, it is possible to accurately detect the turning motion of the casing 11 with respect to the head 12 by using the first turn detector 20A and the second turn detector 20B.

<Configuration of Turn Detector (3)>

Figure 16:
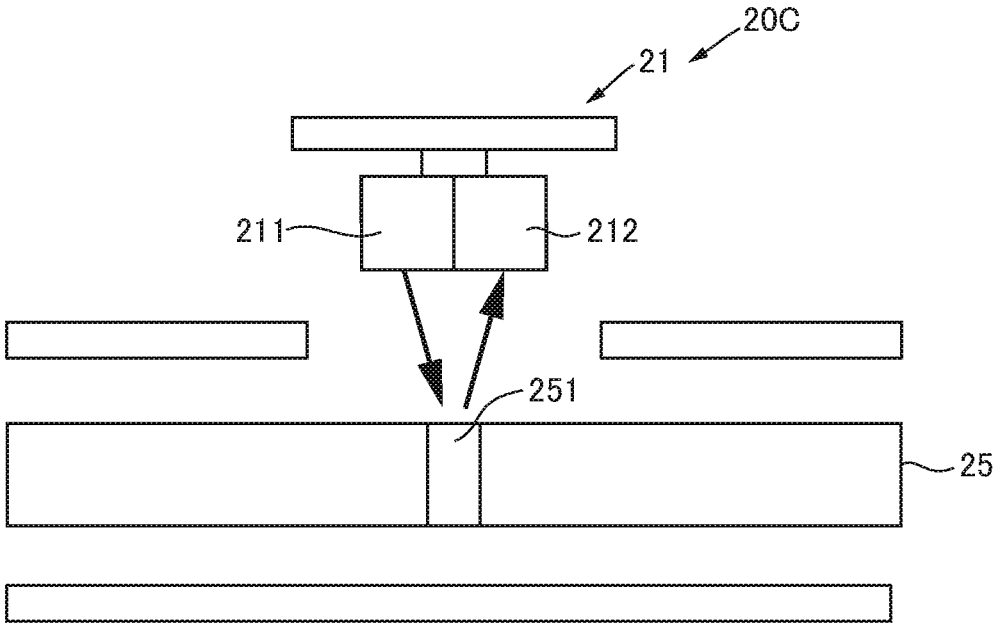
FIG. 16 is a schematic view illustrating further another example of the turn detector of the torque wrench illustrated in FIG. 2.

FIG. 16 is a schematic view illustrating a further another example of the turn detector 20 of the torque wrench 10. As illustrated in FIG. 16, a turn detector 20C employs a light reception varying unit 25 having a plurality of holes 251 that allow the light to pass therethrough provided at regular intervals, instead of the detection lever 22. Only part of the light emitted from the light emitting element 211 which has been reflected by the light reception varying unit 25 can be received by the light receiving element 212, but the light emitted from the light emitting element 211 which has passed through the holes 251 cannot be received by the light receiving element 212. The turn detector 20C detects the turn of the casing 11 in the first direction and the second direction, based on the light receiving state of the light receiving element 212.

As described above, it is possible to accurately detect the turning motion of the casing 11 with respect to the head 12 by the turn detector 20C.

<Configuration of Turn Detector (4)>

Figure 17:
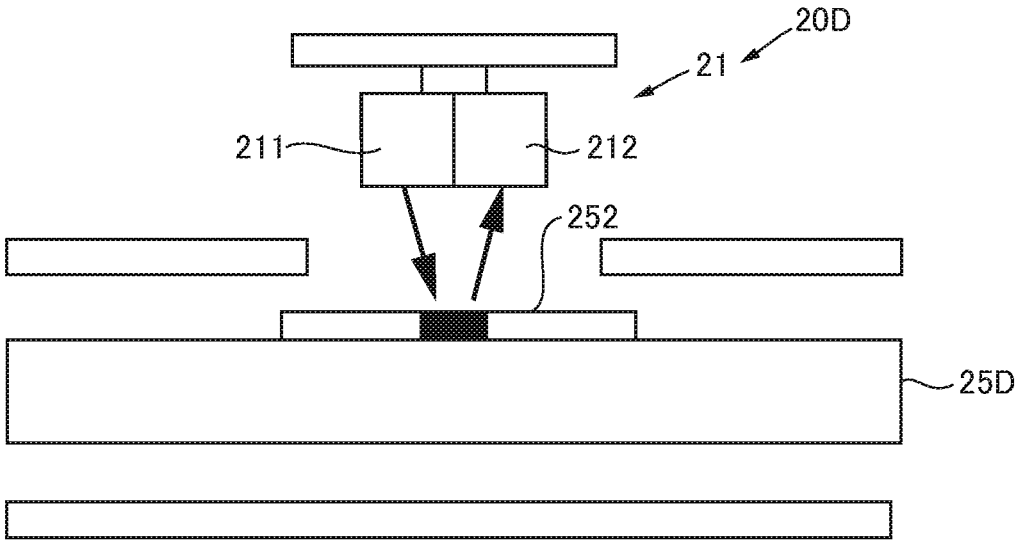
FIG. 17 is a schematic view illustrating further another example of the turn detector of the torque wrench illustrated in FIG. 2.

FIG. 17 is a further another example of the turn detector 20 of the torque wrench 10. As illustrated in FIG. 11, a turn detector 20D employs a light reception varying unit 25D having a reflection seal 252 that reflects light. The light receiving element 212 receives part of the light emitted from the light emitting element 211. That is, the light receiving element 212 receives the light which has been reflected by the reflection seal 252, but does not receive the light reflected by other portions such as the light reception varying unit 25D. The turn detector 20D detects the turning motions of the casing 11 in the first direction and the second direction, based on the light receiving state of the light receiving element 212.

As described above, it is possible to accurately detect the turning motions of the casing 11 with respect to the head 12 by the turn detector 20D.

Here, the light reception varying unit 25 of the turn detector 20 is not limited to the above-described example. The turn detector 20 may detect the variation in the light receiving state of the light receiving element by using another means, such as laser making and printing to vary the surface of the light receiving element.

The invention claimed is:

1. A tightening operation analysis apparatus configured to analyze a tightening operation performed by a worker using a tightening tool, the tightening tool including:

a head configured to be able to engage with a tightened member;

a main body configured to pivotally engage with the head and turn when a tightening torque for tightening the tightened member reaches a preset torque value;

a light emitting element and a light receiving element configured to acquire a turning motion of the main body; and a communication unit configured to transmit information indicating an amount of turn of the main body, based on a variation in a light receiving state of the light receiving element, the tightening operation analysis apparatus comprising:

an information acquisition unit configured to acquire information indicating the amount of turn of the main body, from the tightening tool via the communication unit; and an analysis unit configured to output a result of analysis of a load condition of the tightened member during the tightening operation, based on the information indicating the amount of turn acquired by the information acquisition unit;

wherein when a period of time for which the tightened member is in the load condition is longer than a period of time for which the amount of turn of the main body is appropriate, the analysis unit determines that the tightened member is tightened with an excessive torque greater than the preset torque value.

2. The tightening operation analysis apparatus according to claim 1, wherein:

the tightening tool includes a head pin pivotally supports the head and the main body;

the main body turns around the head pin in a first direction, and then turns in a second direction when the tightening torque reaches the preset torque value; and the information acquisition unit acquires information indicating that the head has turned in the first direction and the second direction as the information indicating the amount of turn.

3. A tightening operation analysis system comprising:

a tightening tool used in a tightening operation performed by a worker; and a tightening operation analysis apparatus configured to analyze the tightening operation by using the tightening tool, the tightening tool including:

a head coupled to a tightened member;

a main body configured to pivotally engage with the head and turn when a tightening torque generated during the tightening operation reaches a preset torque value;

a light emitting element and a light receiving element configured to acquire a turning motion of the main body;

a communication unit configured to transmit information indicating an amount of turn of the main body, based on a variation in a light receiving state of the light receiving element, the tightening operation analysis apparatus including:

a motion information acquisition unit configured to acquire the information indicating the amount of turn of the main body, from the tightening tool via the communication unit; and an analysis unit configured to output a result of analysis of a load condition of the tightened member during the tightening operation, based on the information indicating the amount of turn acquired by the information acquisition unit, wherein when a period of time for which the tightened member is in the load condition is longer than a period of time for which the amount of turn of the main body is appropriate, the analysis unit determines that the tightened member is tightened with an excessive torque value greater than the preset torque value.

4. A tightening operation analysis method executed by a computer, the method comprising:

acquiring information indicating an amount of turn of a main body from a tightening tool, the tightening tool including:

a head coupled to a tightened member, the main body pivotally engaging with the head and turning when a tightening torque for tightening the tightened member reaches a preset torque value;

a light emitting element and a light receiving element configured to acquire a turning motion of the main body; and a communication unit configured to transmit information indicating an amount of turn of the main body, based on a variation in a light receiving state of the light receiving element; and determining that the tightened member is tightened with an excessive torque value greater than the preset torque value when a period of time for which the tightened member is in the load condition is longer than a period of time for which the amount of turn of the main body is appropriate.

* * * * *